US007337477B2

(12) United States Patent
Scordato et al.

(10) Patent No.: US 7,337,477 B2
(45) Date of Patent: Mar. 4, 2008

(54) METHOD AND APPARATUS FOR PATIENT TRANSFER

(75) Inventors: Emil A. Scordato, Clearwater, FL (US); J. Michael Doust, St. Petersburg, FL (US); Scott Hadley, Palm Harbor, FL (US)

(73) Assignee: Stretchair Patient Transfer Systems, Inc., Largo, FL (US)

( * ) Notice: Subject to any disclaimer, the term of this patent is extended or adjusted under 35 U.S.C. 154(b) by 329 days.

(21) Appl. No.: 11/225,967

(22) Filed: Sep. 14, 2005

(65) Prior Publication Data

US 2007/0056095 A1 Mar. 15, 2007

(51) Int. Cl.
*A61G 7/10* (2006.01)

(52) U.S. Cl. ..... 5/81.1 R; 5/81.1 HS; 5/88.1

(58) Field of Classification Search ..... 5/81.1 R, 5/88.1, 81.1 C, 81.1 HS, 81.1 T
See application file for complete search history.

(56) References Cited

U.S. PATENT DOCUMENTS 2,827,642 A * 3/1958 Huff ..... 5/88.1
4,274,168 A 6/1981 Depowski
4,970,738 A 11/1990 Cole
5,036,557 A 8/1991 Fales
5,651,149 A * 7/1997 Garman ..... 5/81.1 R
5,937,456 A 8/1999 Norris
6,341,393 B1 * 1/2002 Votel ..... 5/81.1 T
6,349,432 B1 2/2002 Scordato et al.
6,357,065 B1 3/2002 Adams
6,374,435 B1 4/2002 Leininger et al.
6,378,148 B1 4/2002 Votel
6,484,332 B2 11/2002 Korver, II et al.
6,496,991 B1 * 12/2002 Votel ..... 5/81.1 HS
6,701,544 B2 3/2004 Heimbrock
6,772,456 B2 * 8/2004 Votel ..... 5/81.1 R
6,820,292 B2 11/2004 Heimbrock
6,834,402 B2 12/2004 Hanson et al.
6,916,056 B2 7/2005 Mitchell et al.
2002/0029418 A1 * 3/2002 Votel ..... 5/81.1 RP
2003/0074732 A1 * 4/2003 Hanson et al. ..... 5/81.1 R
2007/0056095 A1 * 3/2007 Scordato et al. ..... 5/81.1 R

* cited by examiner

*Primary Examiner*—Robert G. Santos
(74) *Attorney, Agent, or Firm*—Larson & Larson; Frank Liebenow

(57) ABSTRACT

A patient transfer method and apparatus designed to efficiently move a patient from one surface to another. A set of straps connected at one end to a winch are passed beneath the patient and attached to a padded support rod on the other side of the patient. The winch is used to pull the straps, and hence the padded support rod, thereby pulling the patient from the first surface to the second.

16 Claims, 7 Drawing Sheets

FIG. 7A
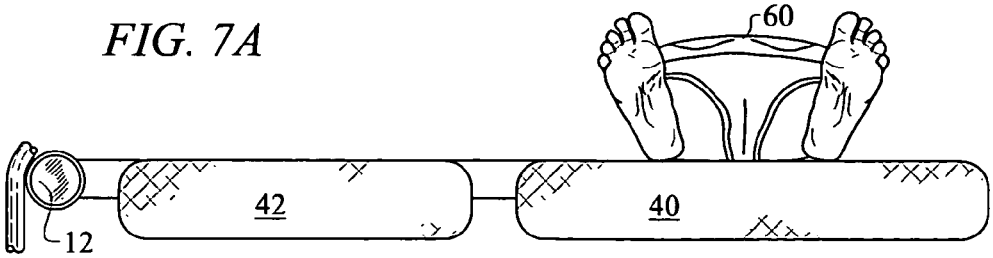
FIG. 7B
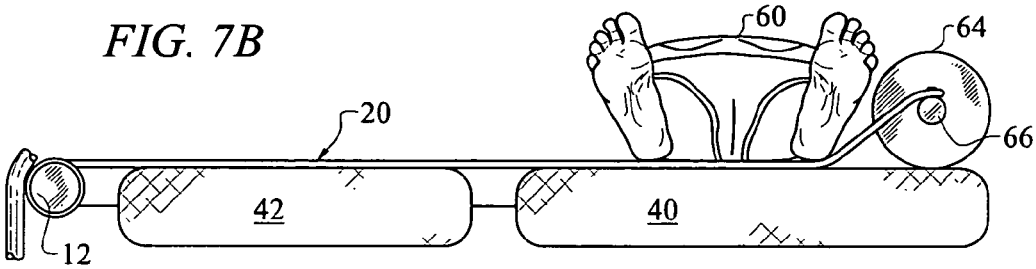
FIG. 7C
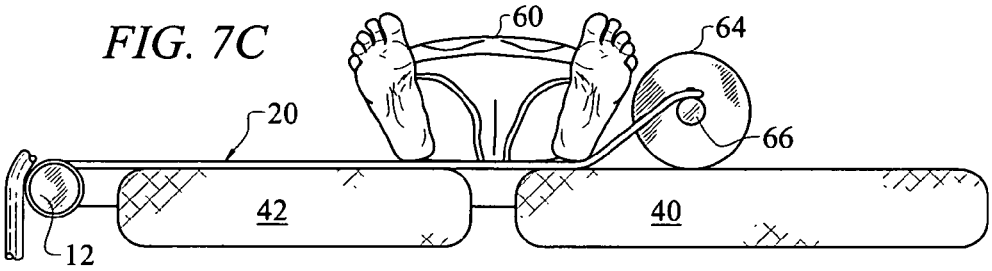
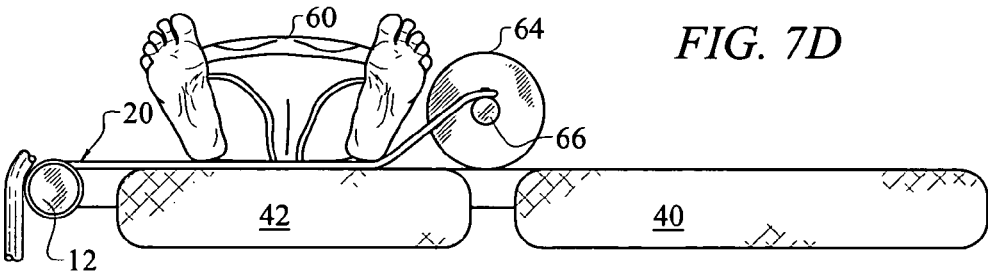
FIG. 7D
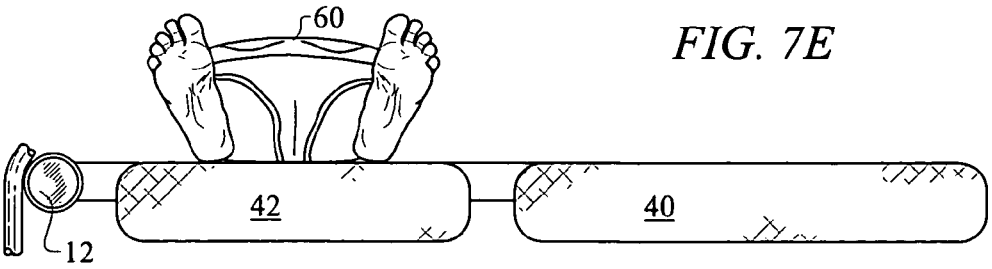
FIG. 7E

METHOD AND APPARATUS FOR PATIENT TRANSFER

BACKGROUND OF THE INVENTION

1. Field of the Invention

This invention relates to the field of transferring patients from one surface to another, and more particularly to a system for aiding in the transfer of a patient from one support surface to another such as from a gurney to a hospital bed.

2. Description of the Related Art

Patients are often transferred from one surface to another surface in medical facilities such as hospitals, clinics and surgery centers. For an operation, the patient is transported on a gurney, requiring a transfer from the hospital bed to the gurney and from the gurney to an operating table and vice versa when the operation is complete. Moving the patient from one surface to another is a difficult task because of the weight and bulk of the patient and the height of the surfaces which don't permit the medical staff to bend their knees to lift the patient, thereby creating severe stress on their backs and other joints and muscles, often leading to serious injuries of the medical staff. This problem is amplified when bariatric patients are involved, where the patient may weigh 400 to 800 pounds or more.

Presently, a patient may be transferred by a practice of placing a heavy-duty sheet under the patient by "log-rolling" the patient to his or her side, placing the sheet underneath the patient, rolling the patient to his or her back and then several medical staff members lifting the patient via the sheet to move the patient from one surface to another. For bariatric patients, often six or more medical staff are often required and many times, injuries occur. Injuries to interns, nurses and other medical staff are very costly to hospitals, surgery centers and the like.

Many ways have been devised to transfer patients from one surface to another. One such device is described in U.S. Pat. No. 6,484,332 to Korver, et al. and is hereby incorporated by reference. This device requires the patient be situated on a patient positioning board; but there is no way for a patient, especially a sedated bariatric patient, to be moved off the positioning board and onto a bed.

U.S. Pat. No. 5,937,456 to Norris is hereby incorporated by reference. This patent describes a device that has a series of conveyor belts. The patient must be log-rolled to his or her side, the conveyor positioned next to the patient, then the patient rolled onto the conveyor belt.

U.S. Pat. No. 6,378,148 to Votel is hereby incorporated by reference. This patent describes a system with a transfer caddy and has a sheet-like material that the patient must be positioned upon, requiring log-rolling the patient in order to position the sheet-like material under the patient. Once positioned on the sheet-like material, the patient is pulled onto the destination surface.

What is needed is a system that will transfer a patient from one surface to another without placing undo stress on the caregivers and without resulting in undo discomfort to the patient.

SUMMARY OF THE INVENTION

In one embodiment, an apparatus for transferring a patient from a first surface to a second surface is disclosed including a winch with two reels and two straps attached to the reels. A buffer cushion system is removably attachable to the two straps for pulling the patient in the direction of the winch from the first surface to the second surface. The buffer cushion system has a bar partially covered with at least one cushion and the bar has at least two attachment points for removably attaching the two straps.

In another embodiment, a method for transferring a patient from a first surface to a second surface is disclosed, including providing a winch with a drive system, two reels operatively coupled to the drive system and two straps attached to the reels. A buffer cushion system for pulling the patient in the direction of the winch from the first surface to the second surface is removably attachable to the two straps and has a bar partially covered with at least one cushion. The bar has at least two attachment points for removably attaching the two straps. A first of the two straps is passed under the patient at a location substantially under the back of the patient and is attached to the bar at a first of the at least two attach points. A second of the two straps is passed under the patient at a location substantially under the gap below the knees of the patient and is attached to the bar at a second of the at least two attachment points. The reels are rotated; thereby pulling the two straps until the patient is transferred from the first surface to the second surface.

In another embodiment, a patient transfer winch system for transferring a patient from a first surface to a second surface is disclosed, including a shaft rotatably coupled to the winch system with two reels mounted to and rotatably coupled to the shaft. Two straps are attached to the reels. A buffer cushion system for pulling the patient in the direction of the winch from the first surface to the second surface is removably attachable to the two straps. The buffer cushion system has a bar partially covered with at least one cushion. The bar has at least two attachment points for removably attaching the two straps.

BRIEF DESCRIPTION OF THE DRAWINGS

The invention can be best understood by those having ordinary skill in the art by reference to the following detailed description when considered in conjunction with the accompanying drawings in which:

FIG. 7*a-e* illustrates the operation of the present invention.

DETAILED DESCRIPTION OF THE INVENTION

Figure 1A:
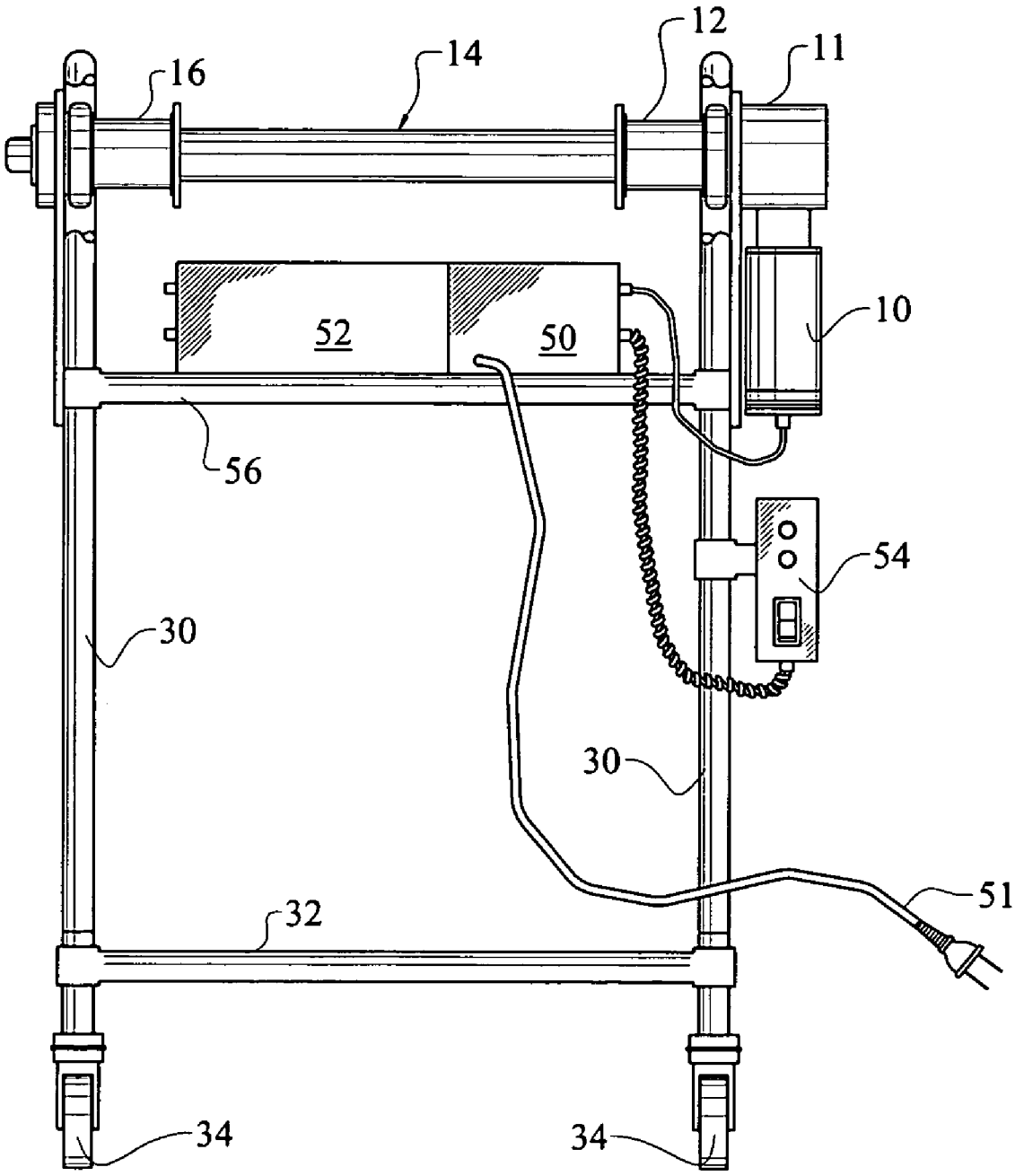
FIG. 1*a* illustrates a side schematic view of a system of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1*a*, a front schematic view of a system of the first embodiment of the present invention is shown. The patient transfer winch system of this embodiment has one motor 10 that drives a shaft 14 through a gear box 11. The motor is controlled by a controller 50 mounted upon a support rail 56 with a detachable remote control 54. The remote control 54 has switches to control the operation of the motor and indicators to provide status such as battery charge status and system power status. In some embodiments, the switches are in the form of a joystick. The switches include, for example, motor speed and direction controls and an emergency stop. Power to the system is provided by a rechargeable battery 52, an example of which is a lead acid battery or nickel metal hydride battery. In some embodiments, the batteries are recharged under control of the controller 50 using external power supplied from a standard power source through power cable 51. In some embodiments, the batteries are removable and are externally charged. The patient transfer system is supported by vertical supports 30 and horizontal supports 32/56. In some embodiments, wheels 34 are provided to ease movement of the winch system.

Two reels 12/16 are coupled to the shaft 14 and will be explained in detail later. In some embodiments, a clutch (not shown) is provided on one or both of the reels 12/16 to control the transfer of rotation independently of the shaft 14 rotation and provide for correction of patient skewing during transfer. In some embodiments, one or both of the two reels 12/16 are adjustable to permit adjustment of the patient's location with respect to each other and to the patient and to accommodate differences in height between different patients.

Figure 1B:
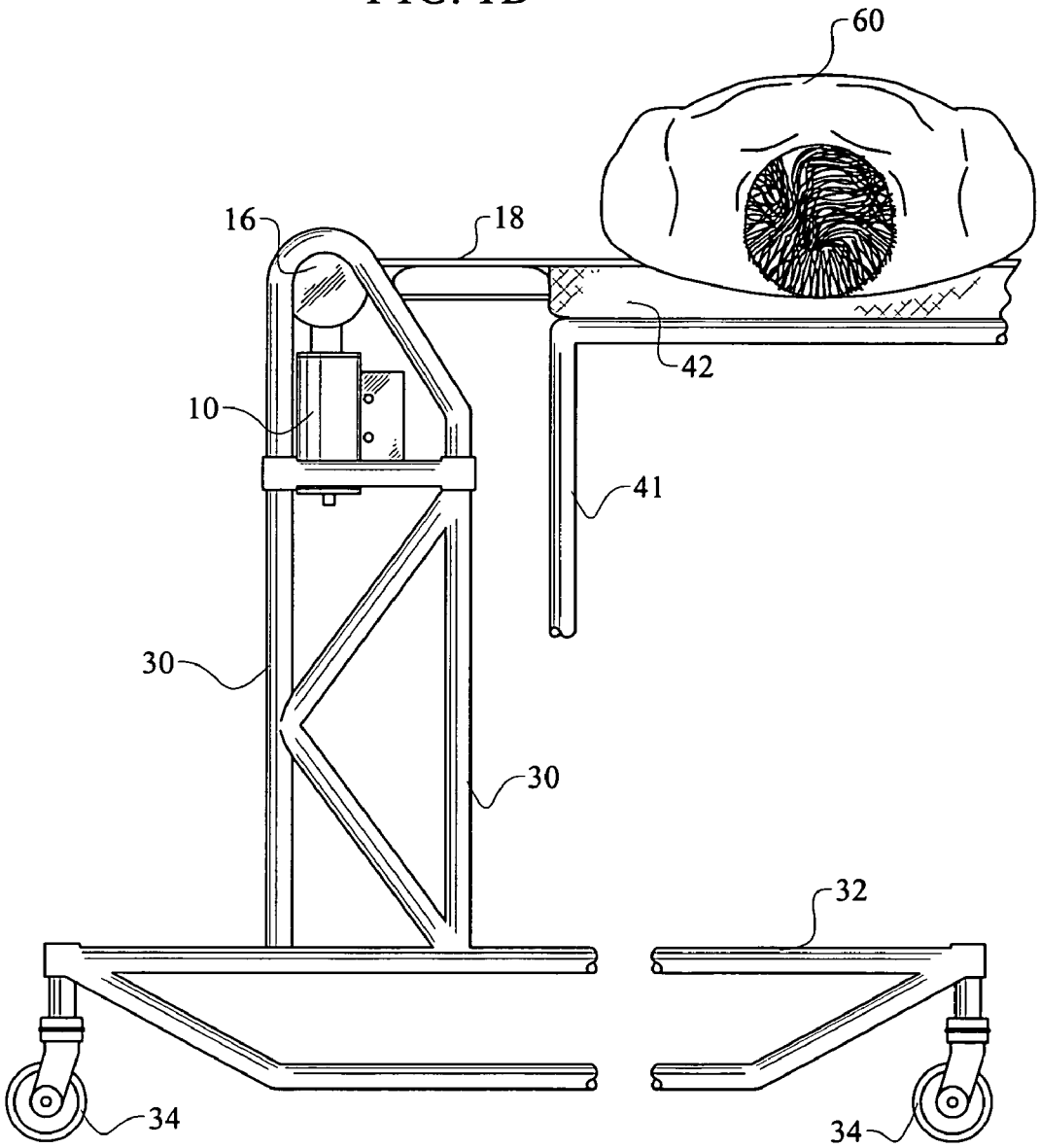
FIG. 1*b* illustrates a front schematic view of a system of the first embodiment of the present invention.

Referring to FIG. 1*b*, a side schematic view of a system of a second embodiment of the present invention is shown. In this view, more detail of the frame is visible, showing the side of the vertical supports 30 and horizontal supports 32 as well as wheels 34. The motor 10 is visible and one of the reels 16 with a patient transfer strap 18 passing under the patient 60, whereas the patient is lying on a surface 42 supported by supports 41.

Figure 2A:
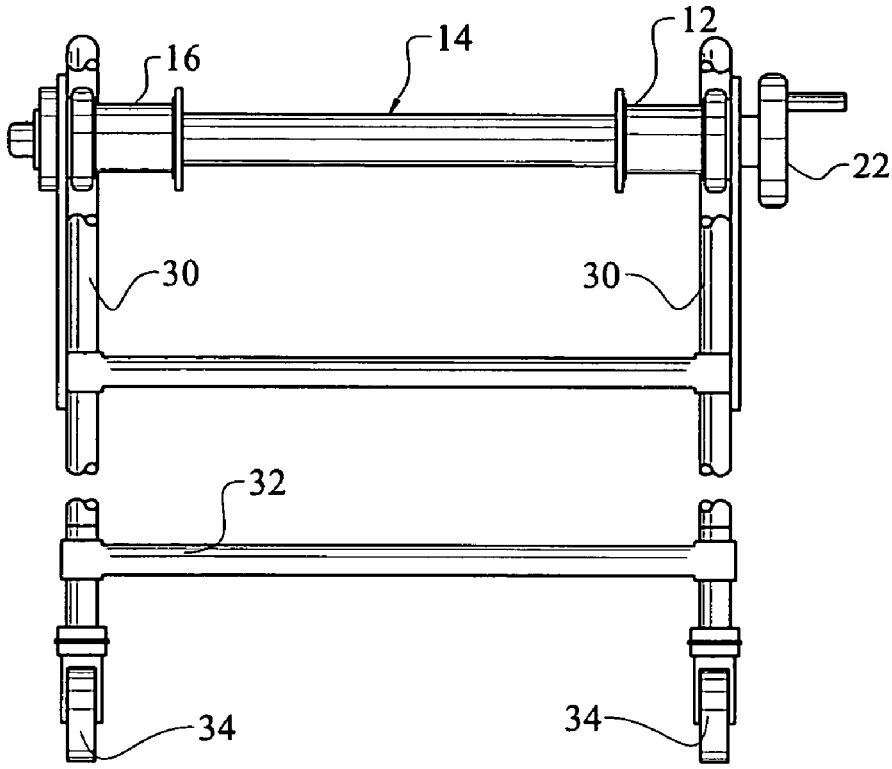
FIG. 2*a* illustrates a side schematic view of a system of a second embodiment of the present invention.

Referring to FIG. 2*a*, a front schematic view of a system of the second embodiment of the present invention is shown. The patient transfer winch system of this embodiment has a had-crank 22 that drives a shaft 14. The patient transfer system is supported by vertical supports 30 and horizontal supports 32. In some embodiments, wheels 34 are provided to ease movement of the winch system. Two reels 12/16 are provided and will be explained in detail later.

Figure 2B:
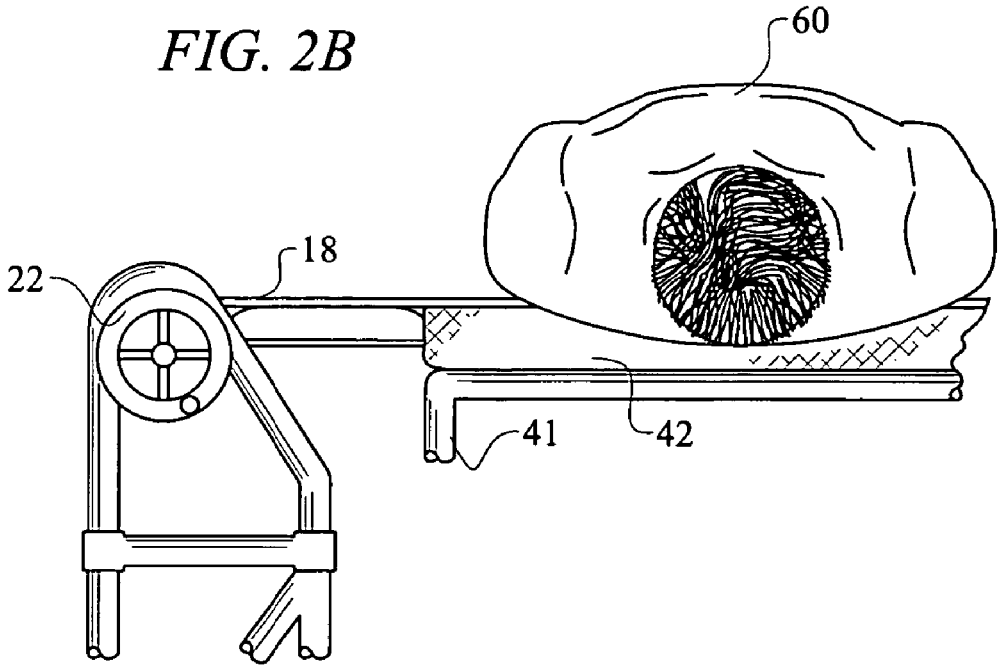
FIG. 2*b* illustrates a front schematic view of a system of the second embodiment of the present invention.

Referring to FIG. 2*b*, a side schematic view of a system of a second embodiment of the present invention is shown. The hand-crank 22 is visible and a patient transfer strap 18 passing under the patient 60, whereas the patient is lying on a surface 42 supported by supports 41.

Figure 3:
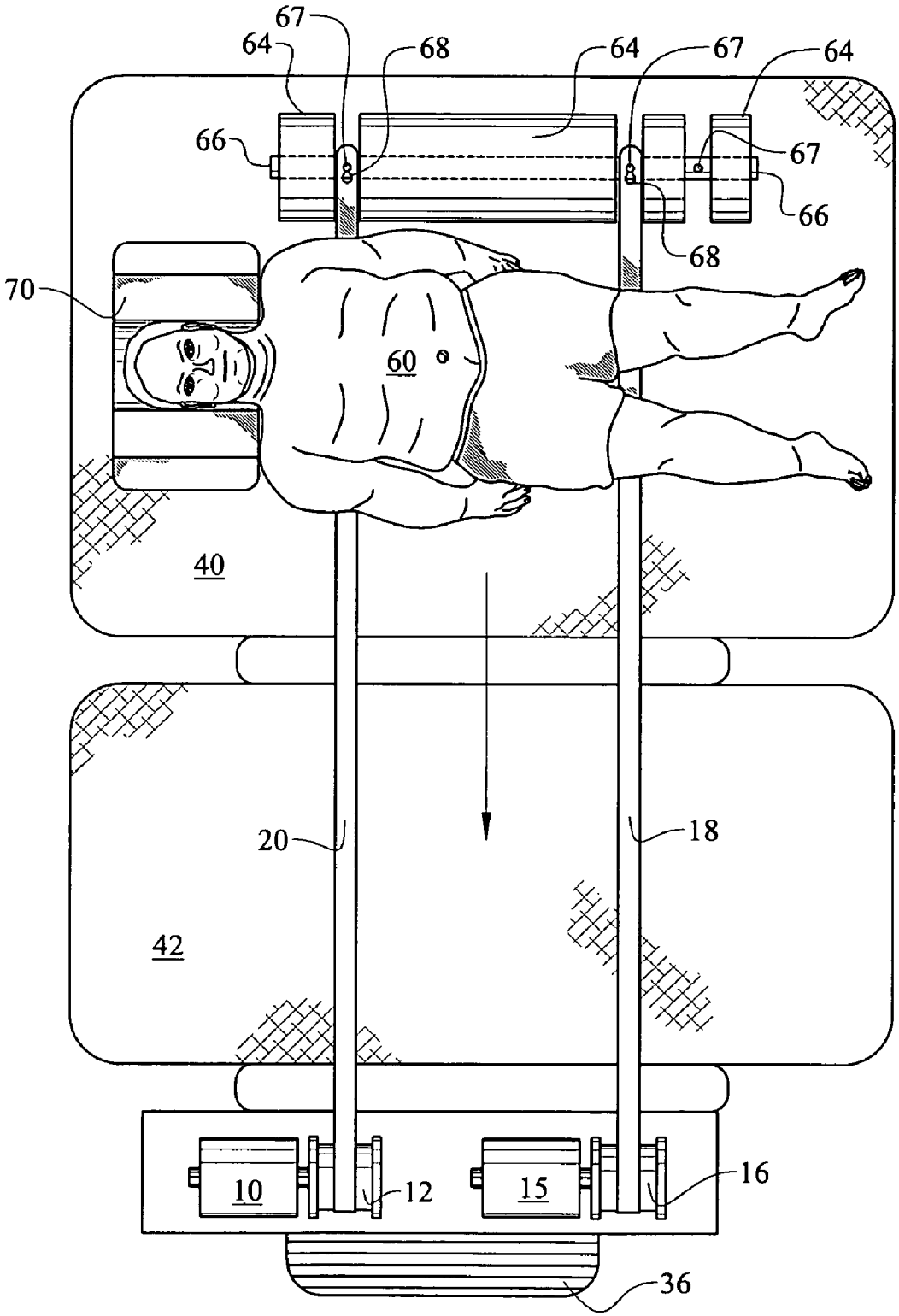
FIG. 3 illustrates a plan view of a system of a third embodiment of the present invention.

Referring to FIG. 3, a plan view of a system of the third embodiment of the present invention is shown. This embodiment differs slightly from the first embodiment, in that two motors 10/15 are provided, each driving a separate reel 12/16. Not shown is the motor control system and remote control as in FIG. 1. In some embodiments, a joystick remote control is provided to allow one-handed operation of both motors.

A patient transfer strap 20/18 is attached to each reel so that as the motors 10/15 turn, the patient transfer straps 20/18 wind around the reels. The patient transfer strap is preferably made of a relatively high-strength material such as polypropylene or polyethylene. Preferably, the straps are made of a smooth, slippery material to aid in passing the straps underneath the patient. The other ends of the patient transfer straps are passed underneath the patient 60 and are removably attached to a buffer cushion system at attachment points 67. In this embodiment, a key hole 68 and key peg 67 system is used to removably attach the patient transfer straps 18/20 to the bar 66, though any suitable method of removable attachment can be used without veering from the present invention. The buffer cushion system comprises a bar 66 covered by one or more soft cushions 64. In some embodiments, extra attachment points or key pegs 67 are provided to accommodate taller patients. The patient 60 is shown lying on his or her back on a first surface 40. In some embodiments, a headcushion 70 is provided. As the motors 10/15 turn, the patient transfer straps 20/18 wrap around the reels 12/16, pulling the buffer cushion system and hence the patient 60 from the first surface 40 to the second surface 42. The headcushion 70 provides additional safety and comfort to the patient as his or her head passes over any gap between the first surface 40 and the second surface 42. In some embodiments, a step 36 is provided to allow the operator better access to the system. In some embodiments, each motor 10/15 is individually controlled to allow the operator to correct any skewing of the patient 60 as he or she moves across the surfaces 40/42.

Figure 4:
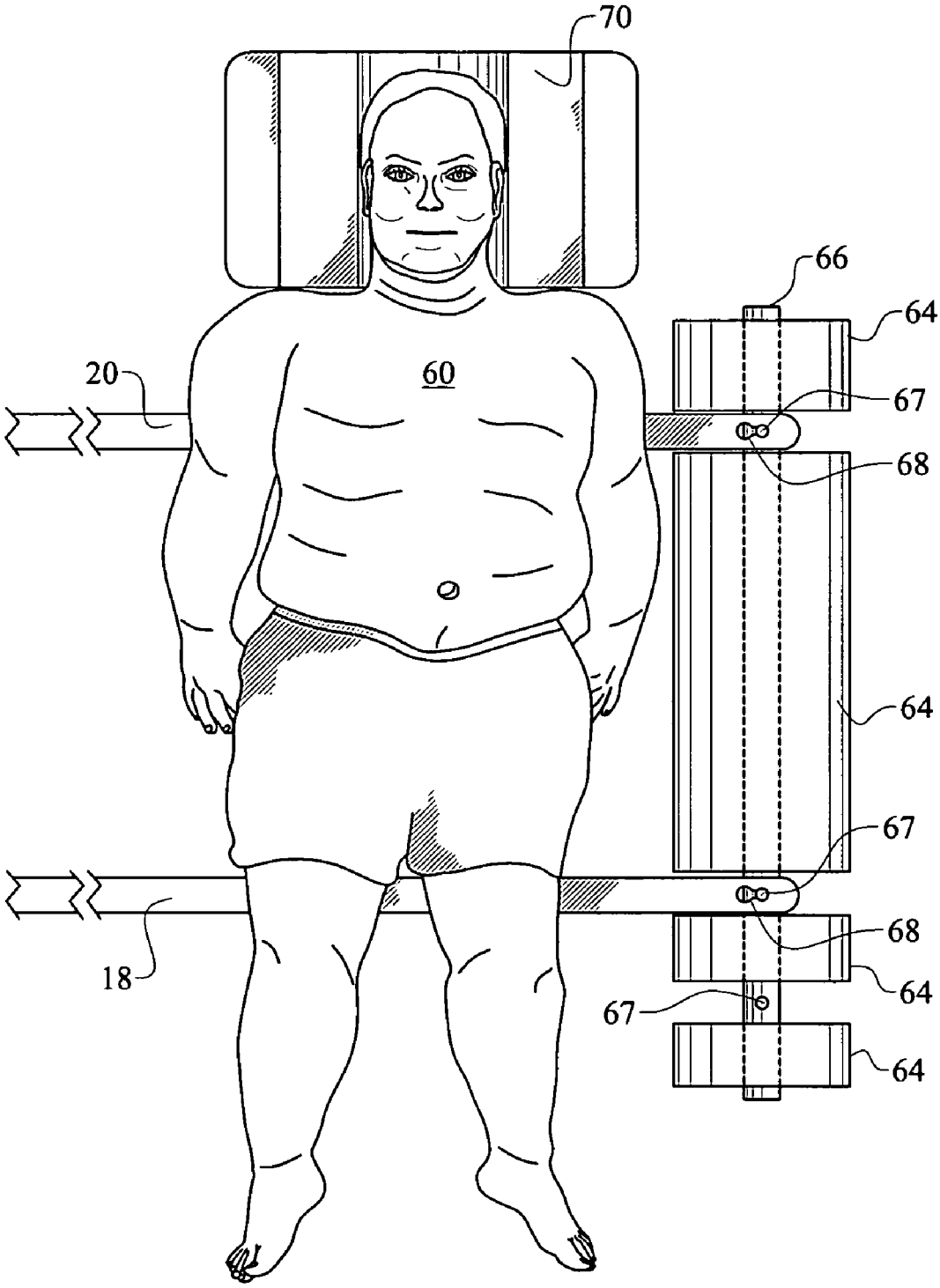
FIG. 4 illustrates a detail view of the patient transport subsystem of both embodiments of the present invention.

Referring to FIG. 4, a detail view of the patient transport subsystem of all embodiments of the present invention is shown. The patient 60 has straps 18/20 passing under his or her back and knees. The straps are removably attached to the buffer cushion bar 66. In this embodiment, the straps 18/20 are attached to key pegs 67 on the bar 66 through keyholes 68. Buffer cushions 64 are provided for comfort to the patient 60 while transferring the patient 60 from one surface to another. In some embodiments, a headcushion 70 is provided to enhance comfort of the patient as they are transferred from one surface to another. The headcushion 70 also helps lift the head of the patient 60, easing the placement of the patient transfer strap 20.

Figure 5:
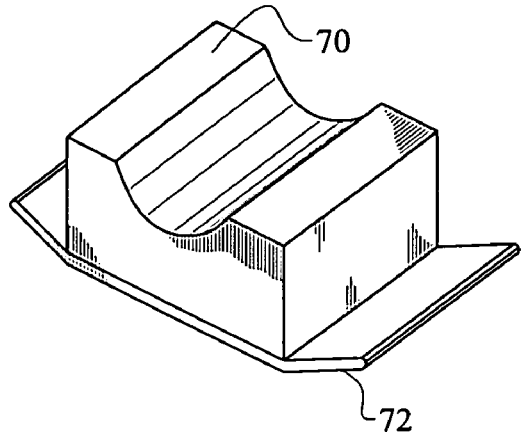
FIG. 5 illustrates a detail view of the headcushion of both embodiments of the present invention.

Referring to FIG. 5, a detail view of the headcushion of both embodiments of the present invention is shown. The headcushion 70 is composed of a soft material such as foam rubber and in some embodiments is covered with cloth or another soft material. In the preferred embodiment, a low-friction transfer surface 72 is attached to the bottom of the headcushion 70 for smoothly sliding across the surfaces and facilitating spanning of any gaps that may exist between the surfaces as the patient 60 moves. In some embodiments, the low-friction transfer surface 72 is angled or curved so as to not catch on the edge of the destination surface.

Figure 6A:
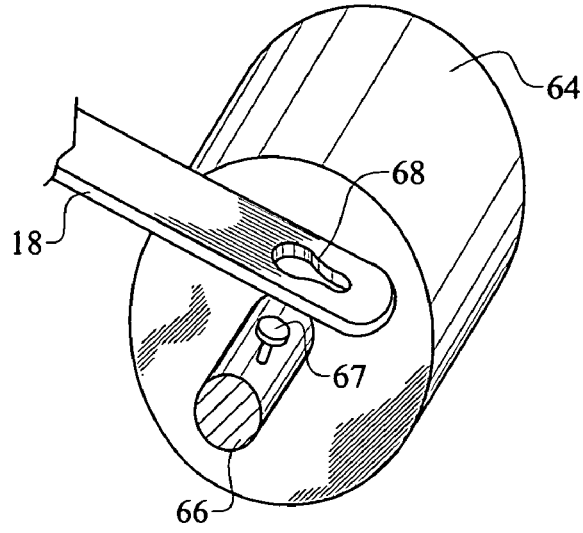
FIG. 6*a* and FIG. 6*b* illustrate a method of attaching the buffer cushion assembly to the transport straps of both embodiments of the present invention.
Figure 6B:
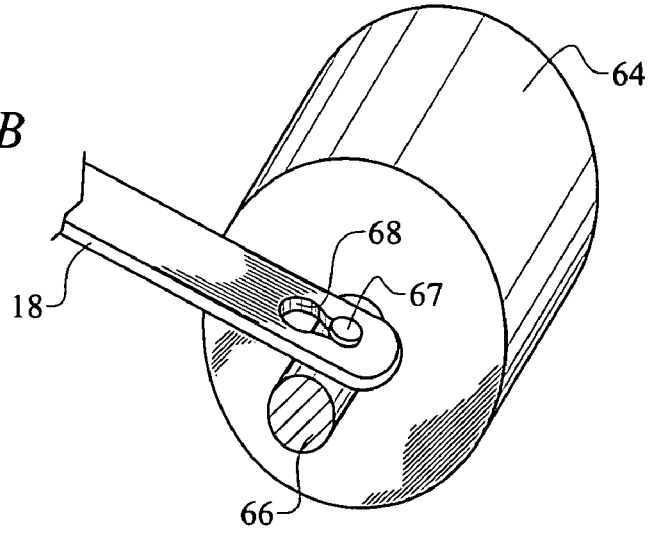

Referring to FIG. 6*a* and FIG. 6*b*, one of several methods of attaching the buffer cushion system to the transport straps of both embodiments of the present invention is shown. The strap 18 has a key hole 68 with an opening at one end large enough to accept the head of the key peg 67 and a smaller opening at the opposite end that is large enough to accept the shaft of the key peg 67 but smaller than the head of the key 67, such that the key 67 will not pass through that part of the key hole 68. In FIG. 6*a*, the large opening end of the key hole 68 is positioned over the key 67, then in FIG. 6*b*, the strap 18 is pulled so that the smaller opening of the key hole 68 is positioned around the shaft of the key 67, thereby removably joining the shaft and strap. The strap 18 can easily be removed from the key peg 67 by pushing the strap 18 until the larger opening end of the key hole 68 is over the key peg 67 and lifting to remove. In other embodiments, the other ends of the straps 18/20 are removably attached to the reels 12/16.

Referring to FIG. 7*a-e*, the operation of the present invention is shown. In FIG. 7*a*, the patient 60 is shown lying on his or her back on a first surface 40. The first surface 40 is positioned next to a second surface 42. Only the reel 12 of the patient transfer winch system is shown for brevity. In FIG. 7*b*, the strap 20 from reel 12 is passed under the patient 60, preferably under the patient's knees. A similar strap 18 (not visible) is passed under the patient's shoulders. The straps are attached to the buffer cushion system bar 66 which has an annular cushion 64 around it. The headcushion 70 is not visible in this example, but is provided in the preferred embodiment. In FIG. 7*c*, the motor(s) 10/15 have been energized and the straps begin pulling the buffer cushion bar 66 and hence the buffer cushion 64 towards the winch, hence pulling the patient 60 from the first surface 40 to the destination surface 42. In FIG. 7*d*, the patient 60 is resting on the destination surface 42. In FIG. 7*e*, the straps 20 have been removed and the buffer cushion 64 taken away. At this time, the winch system can be moved and used with another patient.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. An apparatus for transferring a patient from a first surface to a second surface, the apparatus comprising:

a winch having two reels;

two straps attached to the reels;

a buffer cushion system for pushing the patient in the direction of the winch from the first surface to the second surface, the buffer cushion system having a bar, the bar being partially covered with at least one cushion, the bar having at least two attachment points for removably attaching the two straps;

whereas the two straps pass beneath the patient and the buffer cushion is attached to the two straps and the buffer cushion applies a pushing force directly to the patient in response to the two straps being pulled by the winch.

2. The apparatus of claim 1, wherein the two reels are operatively coupled to at least one motor.

3. The apparatus of claim 2, wherein the at least one motor is powered from a rechargeable battery.

4. The apparatus of claim 3, wherein the at least one motor is controlled by a remote control.

5. The apparatus of claim 1, further comprising a headcushion.

6. The apparatus of claim 1, wherein the two reels are operatively coupled to a hand-crank.

7. The apparatus of claim 1, wherein the at least two attachment points are at least two key pegs and each of the two scraps has a key hole for removably attaching to the at least two key pets.

8. The apparatus of claim 1, wherein at least one of the two reels is movable to allow adjustment of the distance between the two reels, compensating for height differences of the patient.

9. A patient transfer winch system for transferring a patient from a first surface to a second surface, the apparatus comprising:

a shaft rotatably coupled to the winch system;

two reels mounted to the shaft and rotatably coupled to the shaft;

two straps attached to the reels;

a buffer cushion system for pushing the patient in the direction of the winch from the first surface to the second surface, the buffer cushion system having a bar, the bar being partially covered with at least one pillow, the bar having at least two attachment points for removably attaching the two straps;

whereas the two strays pass beneath the patient and the buffer cushion is attached to the two straps and the buffer cushion applies force directly to the patient in response to the two straps being pulled by the winch.

10. The patient transfer winch system of claim 9, wherein the shaft is operatively coupled to at least one motor.

11. The patient transfer winch system of claim 10, wherein the at least one motor is powered from a rechargeable battery.

12. The patient transfer winch system of claim 10, wherein the at least, one motor is controlled by a remote control.

13. The patient transfer winch system of claim 9, further comprising a headcushion.

14. The patient transfer winch system of claim 9, wherein the shaft is operatively coupled to a hand-crank.

15. The patient transfer winch system of claim 9, wherein the at least two attachment points are at least two key pegs and each of the two straps has a key hole for removably attaching to the at least two key pegs.

16. The patient transfer winch system of claim 9, wherein at least one of the two reels is movable along the shaft to allow adjustment of the distance between the two reels compensating for height differences of the patient.

* * * * *